US006897824B2

(12) United States Patent
Gerhard

(10) Patent No.: US 6,897,824 B2
(45) Date of Patent: May 24, 2005

(54) PLANAR ANTENNA WITH WAVE GUIDE CONFIGURATION

(76) Inventor: Walter Gerhard, Wrangelstrasse 14, Kiel (DE), 24105

( * ) Notice: Subject to any disclaimer, the term of this patent is extended or adjusted under 35 U.S.C. 154(b) by 251 days.

(21) Appl. No.: 10/311,529

(22) PCT Filed: Jun. 18, 2001

(86) PCT No.: PCT/EP01/06839

§ 371 (c)(1),
(2), (4) Date: Dec. 13, 2002

(87) PCT Pub. No.: WO01/97330

PCT Pub. Date: Dec. 20, 2001

(65) Prior Publication Data

US 2004/0113857 A1 Jun. 17, 2004

(30) Foreign Application Priority Data

Jun. 16, 2000 (DE) ..... 100 28 937

(51) Int. Cl.[7] ..... H01Q 13/00
(52) U.S. Cl. ..... 343/776; 343/778; 333/137
(58) Field of Search ..... 343/772, 776, 343/778, 789, 781 R, 781 P; 333/137, 136

(56) References Cited

U.S. PATENT DOCUMENTS

| | | | | |
|---|---|---|---|---|
| 3,801,939 A | | 4/1974 | Lamy et al. | 333/239 |
| 4,121,220 A | * | 10/1978 | Scillieri et al. | 343/768 |
| 4,743,915 A | | 5/1988 | Rammos et al. | 343/776 |
| 4,783,663 A | | 11/1988 | Rammos et al. | 343/778 |
| 5,243,357 A | | 9/1993 | Koike et al. | 343/776 |
| 5,475,394 A | | 12/1995 | Kohls et al. | 343/700 MS |
| 5,568,160 A | | 10/1996 | Collins | 343/778 |
| 5,926,147 A | | 7/1999 | Sehm et al. | 343/776 |
| 6,034,647 A | | 3/2000 | Paul et al. | 343/776 |
| 6,215,444 B1 | | 4/2001 | Engeln | 343/700 MS |
| 6,563,398 B1 | * | 5/2003 | Wu | 333/137 |

FOREIGN PATENT DOCUMENTS

| | | | |
|---|---|---|---|
| DE | 40 35 793 A1 | | 5/1992 |
| DE | 196 38 085 A1 | | 3/1998 |
| EP | 0 569 017 A2 | | 11/1993 |
| EP | 1199772 | * | 4/2002 |
| WO | WO 00/28620 | | 5/2000 |

OTHER PUBLICATIONS

"Broadside Printed Antenna Arrays Built with Dissymmetrical Subarrays," Electronics Letters, vol. 27, No. 5, Feb. 28, 1991.

Yoshiki, "A Broadband Planar Antenna Employing Waveguide Parallel Feed Circuit," 0–7803–2009–3/94, p. 1862–1866.

* cited by examiner

*Primary Examiner*—Wilson Lee
*Assistant Examiner*—Ephrem Alemu
(74) *Attorney, Agent, or Firm*—King & Jovanovic, PLC

(57) ABSTRACT

A planar array antenna comprising at least two groups of radiating elements, the two groups being arranged on one plane and connected to one coupling point respectively by means of one transmission network respectively. A wave guide configuration connects the coupling points to a common central coupling point. The E field vectors of the electromagnetic waves directed into the wave guide configuration are oriented parallel to the flat sides of the planar array antennae.

32 Claims, 9 Drawing Sheets

Fig. 6
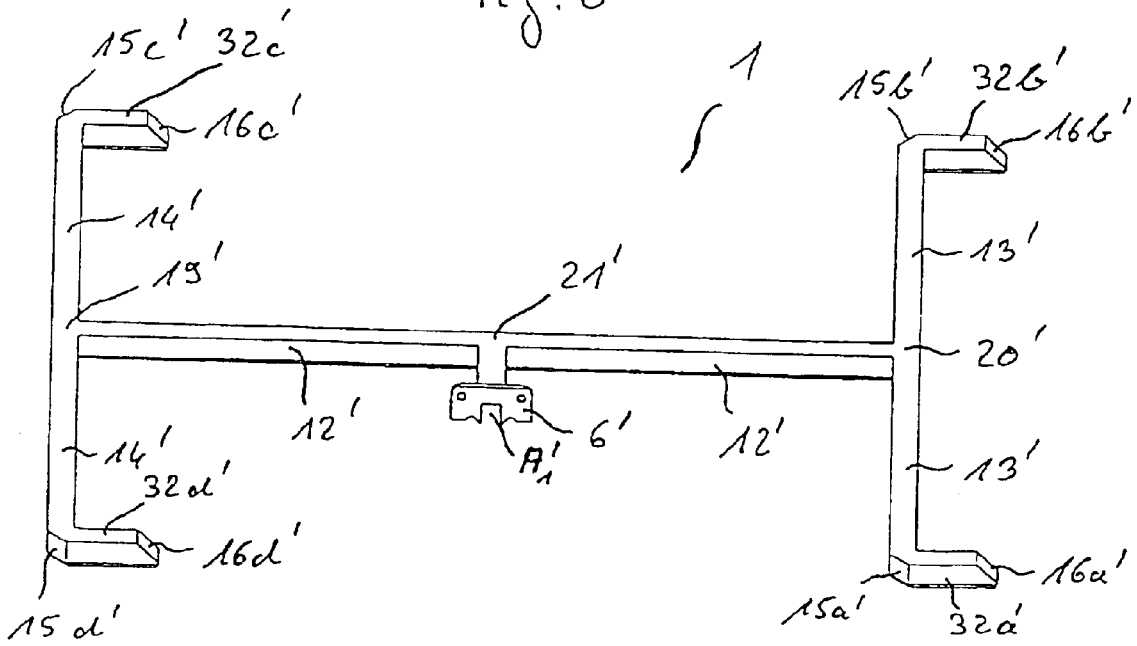
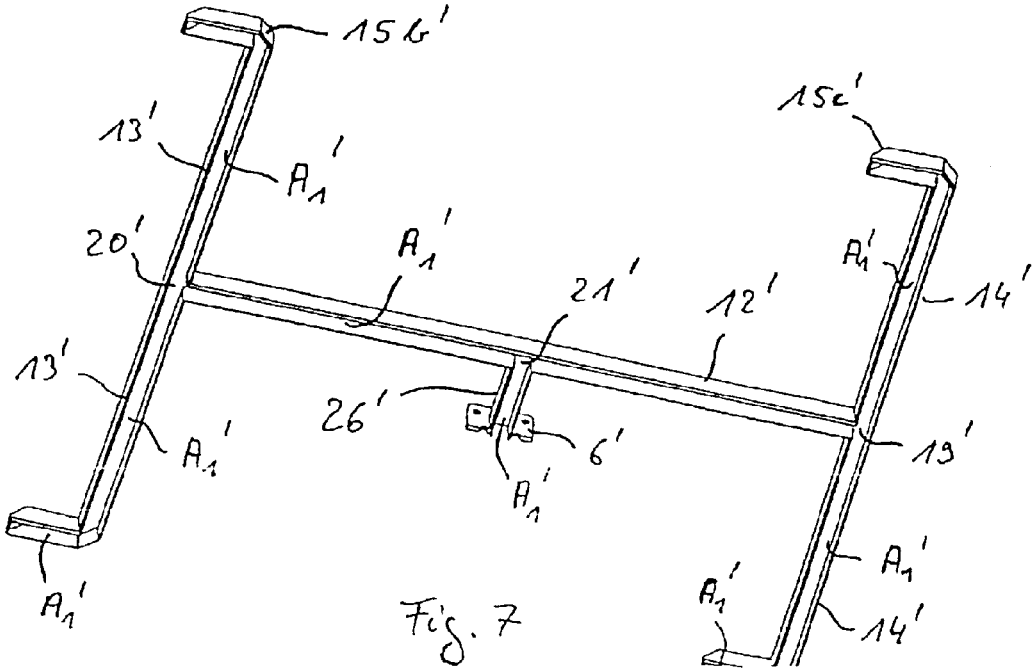
Fig. 7

PLANAR ANTENNA WITH WAVE GUIDE CONFIGURATION

FIELD OF THE INVENTION

The present invention relates to a planar antenna, and more particularly, to a planar antenna comprising at least two groups of radiating elements arranged in one plane, which are connected to one coupling point in each case by means of one transmission network in each case, one wave guide configuration connecting the coupling points to a common central coupling point.

BACKGROUND ART

In order to increase the efficiency (G/T) of an antenna system it is possible to combine a plurality of antennae to form a large antenna, the signals of the individual antennae being superimposed to form a common signal. It is thereby possible to receive even weak signals which could not be received with sufficient quality by means of single smaller antenna. The gain of planar antennae can be increased, for example, by connecting a large number of radiating elements by means of a common coupling network to a common feed point. Because the radiating elements cannot be arranged with any desired density side-by-side in one plane the length of lines between radiating elements and coupling point constantly increases with a constantly increasing number of radiating elements, so that the loss to the antenna caused by the coupling network becomes unacceptable.

Known from U.S. Pat. No. 5,475,394 is a planar antenna which is composed of four individual smaller planar antennae. Each of the four planar antennae forms a quadrant of the large square antenna, each of the four planar antennae having a feed network to supply their radiation elements. To achieve the highest possible directivity the four feed points of the four individual planar antennae are coupled at equal amplitude and in an in-phase and low-loss manner to a common coupling point or feed point by means of a waveguide system. Also known from U.S. Pat. No. 5,475,394 is a planar antenna in which two planar antennae are arranged one behind the other and each consist of four smaller planar antennae, which in each case form quadrants of a square. The feed points of the four planar antennae disposed in one plane are in each case connected, as described above, to a common coupling point or feed point by means of their own waveguide system.

A disadvantage of the planar antennae with waveguide configurations known from U.S. Pat. No. 5,474,394 is that, to achieve the best possible HF characteristics, the waveguide structure would have to be manufactured in one piece. The known technical procedures for achieving this are all complex and expensive. The fundamental problem lies in removing the core of relatively complex waveguide structures which in practice are produced by connecting three or more partial elements. Core removal is conventionally carried out by the melt-out method. An advantageous splitting of the waveguide system into individual components which are subsequently connected is also complex and expensive because, in view of the selected waveguide structure and the dominant mode associated therewith ($H_{10}$ mode or $TE_{10}$ mode in waveguides with rectangular cross-section) the wall currents are interrupted at the cut edges, causing undesirable reflections which can seriously impair the entire complex power distribution in the waveguide network. The contact problem arising here between the partial components to be connected makes a low-cost solution impossible.

Also known from U.S. Pat. No. 5,243,357 is an antenna for simultaneous reception of two orthogonal electromagnetic waves in which the radiating elements are coupled to a common coupling point by means of a waveguide configuration. The waveguide of the waveguide configuration has a square cross-sectional area since otherwise the two orthogonal electromagnetic waves could not be propagated therein. The above-mentioned disadvantages, as present in the case of the antenna according to U.S. Pat. No. 5,475,394, also apply to this antenna.

Known from European Patent Application EP 0569017 is a waveguide configuration in which a waveguide consists of two parts each of which has an elongated recess in one of its flat sides, the recesses together forming the cavity of the waveguide. Known from Yoshiki K et al: "A broadband planar antenna employing waveguide parallel feed circuit", 1994, IEEE, pp. 1862–1865, XP000546058 ISBN: 0-7803-2009-3 , is a planar antenna in which a plurality of radiating elements are fed via a complex waveguide configuration. The essay does not, however, disclose the concrete structure of the waveguide configuration.

It is therefore one object of the present invention to provide a generic planar antenna with a waveguide configuration for in-phase coupling of the coupling points of the individual planar antennae to the common coupling point, which planar antenna is, on the one hand, simple in structure and therefore economical to mass produce with suitable manufacturing technologies and, on the other hand, ensures optimum, reflection-free wave guidance, even taking account of manufacturing tolerances.

Other objects of the present invention shall become apparent in light of the specification and claims.

SUMMARY OF THE INVENTION

The foregoing object, as well as other objects, are achieved according to the invention by one of the planar antennae comprising at least two groups of radiating elements arranged in one plane, which are connected to one coupling point in each case by means of one transmission network in each case, one waveguide configuration connecting the coupling points to a common central coupling point, characterised in that two parts arranged one above the other form the waveguide configuration, the parts having recesses which together form the cavities of the waveguides, the depths of the recesses of the parts being equal, such that the contact edges of the recesses coincide with the centre line of the side, in particular the wide side, of the waveguide in which only longitudinal currents flow.

The planar antennae according to the invention are distinguished by the fact that the E-field vectors of the electromagnetic $H_{10}$ mode ($TE_{10}$) guided in the waveguide configuration are oriented parallel to the flat sides of the planar antennae, i.e. the E-side of the waveguide coincides with the flat side of the antenna, and the waveguide configuration consists of two or three parts.

In this way an advantageous division of the waveguide system into individual components which can be manufactured separately and then combined into a complex waveguide network can be realised.

The waveguide configuration can be advantageously formed as a sandwich structure, it being possible to manufacture the entire waveguide system for in-phase connection of the common coupling point to the respective coupling points of a planar antenna from only two or three parts, each of which has recesses, in particular groove-shaped recesses, forming the waveguide.

The $H_{10}$ mode is guided via a suitable waveguide network from the common central coupling or feed point to the respective coupling points of the quadrant planar antennae.

The waveguide network realised here has the special feature of T-junctions in the E-plane of the waveguide which produce a phase difference of 180°, provided that H-T junctions, as known from U.S. Pat. No. 4,574,394, are not used.

The planar antennae according to the invention use E-T-junctions which, admittedly, produce a phase angle rotation of the wave which is guided; nevertheless, the use of the E-T-junctions at the same time makes possible a simple structure of the waveguide configuration.

The simplest configuration of a waveguide configuration for connecting the common coupling point to the four coupling points of the planar antennae forming the quadrants takes the form of a double T-beam in which the coupling points of the planar antennae forming the quadrants are in each case connected to one of the free ends of the configuration. Two connecting waveguides arranged parallel to one another therefore exist, each of which connects two adjacent coupling points, the two connecting waveguides being connected via a further central waveguide which, in particular, adjoins their centres. Coupling into and out of the waveguide network is effected via the centre of this further central waveguide.

Because, as a result of the E-T-junctions, the waves in the respective branches are phase-offset by 180° with respect to each other, a 90° E-bend, which vectorially aligns the E-vectors of the waveguide wave at the transition from the waveguide to a stripline system, must be additionally inserted, so that said vectors have the same direction. The subsequent transition from the waveguide disposed parallel to the antenna to the sub-quadrants is effected by means of compensated 90° H-bends.

The above-described waveguide configurations for the planar antenna according to the invention make it possible to use the same layouts of the radiating elements and of the coupling networks for the individual planar antennae forming these quadrants, so that the planar antennae can be produced at advantageously low cost.

In the case of an $H_{10}$ mode only longitudinal currents flow on the imaginary centre-line of the wide side of a rectangular waveguide. The waveguide can therefore be split at this centre-line of the wide side of the waveguide without impairing the operation of the waveguide or of the waveguide configuration. Because the wide side of the waveguide in the above-mentioned US patent is oriented parallel to the flat antenna arrangement the waveguide configuration is complicated in itself and cannot be produced at low cost.

In the case of the planar antenna according to the present invention and its waveguide configuration, by contrast, the wide side of the waveguide configuration is oriented perpendicularly to the flat side of the planar antenna. If the waveguide configuration is now divided at the centre line of the wide side of the rectangular waveguide, two parts are produced which can be manufactured in an advantageously simple and low-cost manner.

The parts, which can be stacked in a sandwich formation and together form a waveguide configuration, are advantageously made, for reasons of weight, of a lightweight material such as plastics material, at least the inner faces of the recesses forming the waveguide being metallised.

If the planar antenna consists of two planar antennae arranged one behind the other, each of which comprises a plurality of sub-planar antennae which, for example, form quadrants, it is necessary to provide two waveguide configurations. The feed points of the planar antennae forming the quadrants of the respective planar antennae arranged one behind the other do not coincide, to make possible coupling out from the rear planar antenna, seen from the waveguide configuration, through the planar antenna adjacent to the waveguide configuration. The offset is relatively small as a result of the small dimensions of the stripline and of the radiating elements. As the waveguide configurations are built up in a sandwich formation the two waveguide configurations can be realised by means of three parts, the centre part having recesses in its opposed flat sides which, together with the recesses in the other two "lid" or cover sections, form the waveguides of the waveguide configurations.

BRIEF DESCRIPTION OF THE DRAWINGS

An embodiment of a waveguide configuration for a planar antenna having radiating elements arranged in two planes, with four groups and an identical coupling network in each case, is described below. Two waves polarised orthogonally with respect to one another can, for example, be received or transmitted by means of this planar antenna. It is also possible, however, for signals of different frequencies to be transmitted or received by means of the two levels. In the drawings:

FIGS. 6,7 are perspective views of the upper cover part of the waveguide configuration;

DETAILED DESCRIPTION OF THE DRAWINGS

Figure 1:
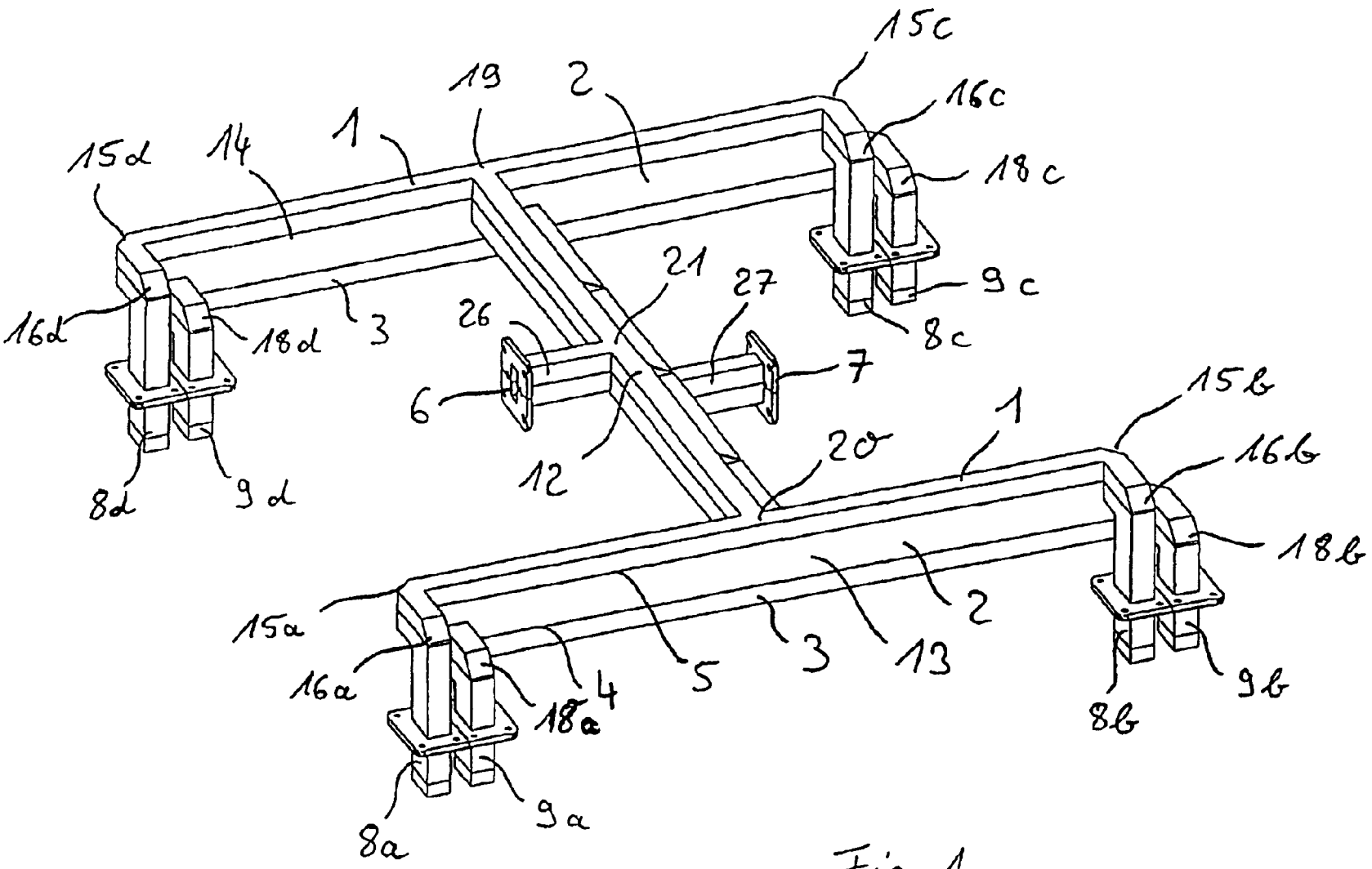
FIG. 1 is a perspective view of an assembled waveguide configuration.

FIG. 1 shows a perspective view of a waveguide configuration for a planar antenna comprising groups of radiating elements arranged in two planes, each group having its own feed or coupling point which is connected in-phase to a common coupling point 6, 7 via the waveguide configuration. The waveguide configuration consists of the upper cover part 1, the centre part 2 and the lower cover part 3. The cover part 3 can but need not be adjacent to the planar antenna or form an integral component of the planar antenna. The separation lines between the three parts 1, 2, and 3 are designated by reference numerals 4 and 5.

The waveguide configuration takes substantially the form of a double T-beam and is composed of the two long rectilinear connecting waveguide parts 13 and 14 which are connected by means of the further waveguide part—hereinafter called the central waveguide part 12. Both the central waveguide part 12 and the connecting waveguide parts 13 and 14 form together in each case two waveguide configurations $A_1$ and $A_2$, reference numeral 6 designating the coupling point for waveguide $A_1$ and reference numeral 7 the coupling point for waveguide $A_2$. The central coupling points 6 and 7 have flanges to which the electronic system of the planar antenna can be coupled and to which the associated connections can be attached.

Figure 2:
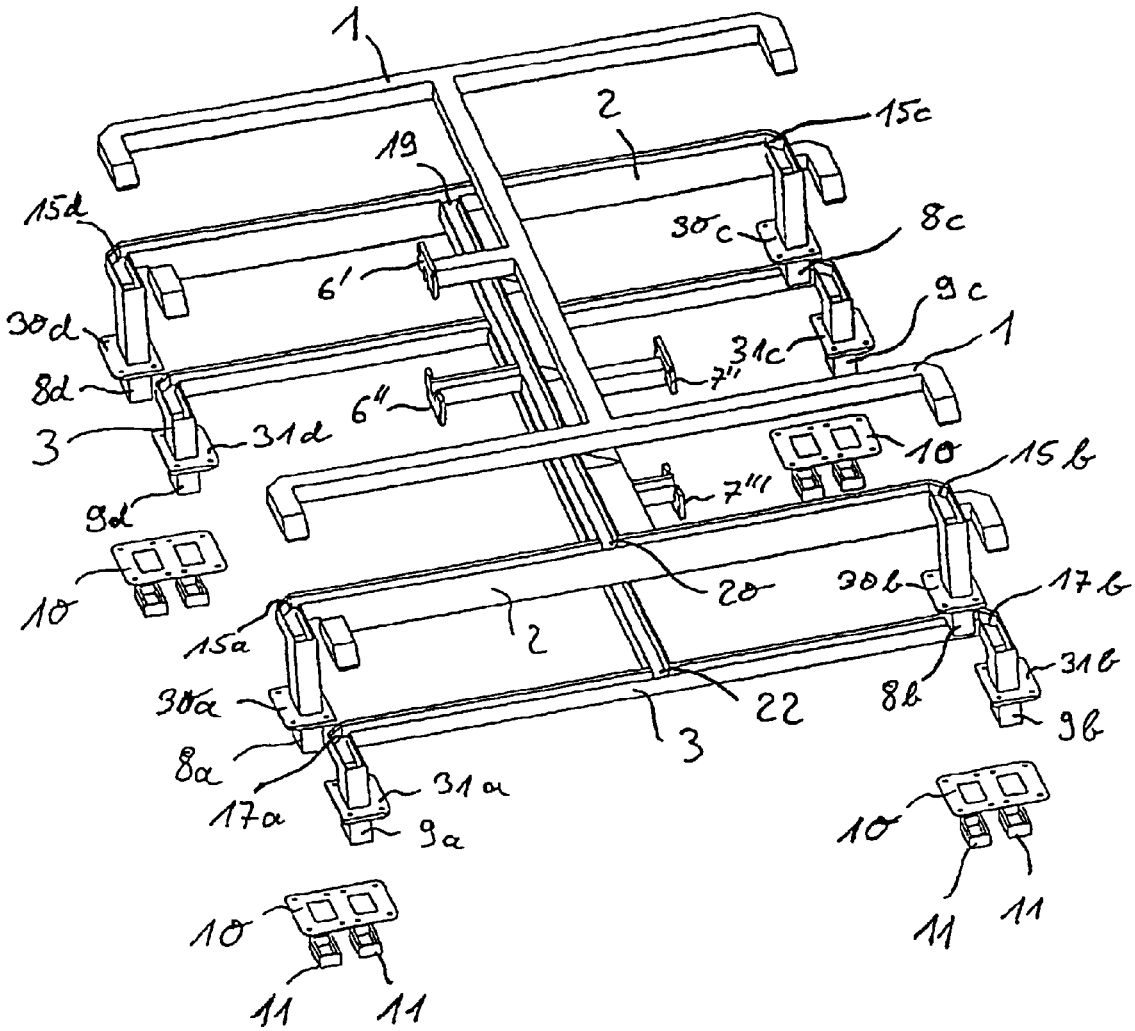
FIG. 2 is an exploded drawing of the waveguide configuration according to FIG. 1.
Figure 5:
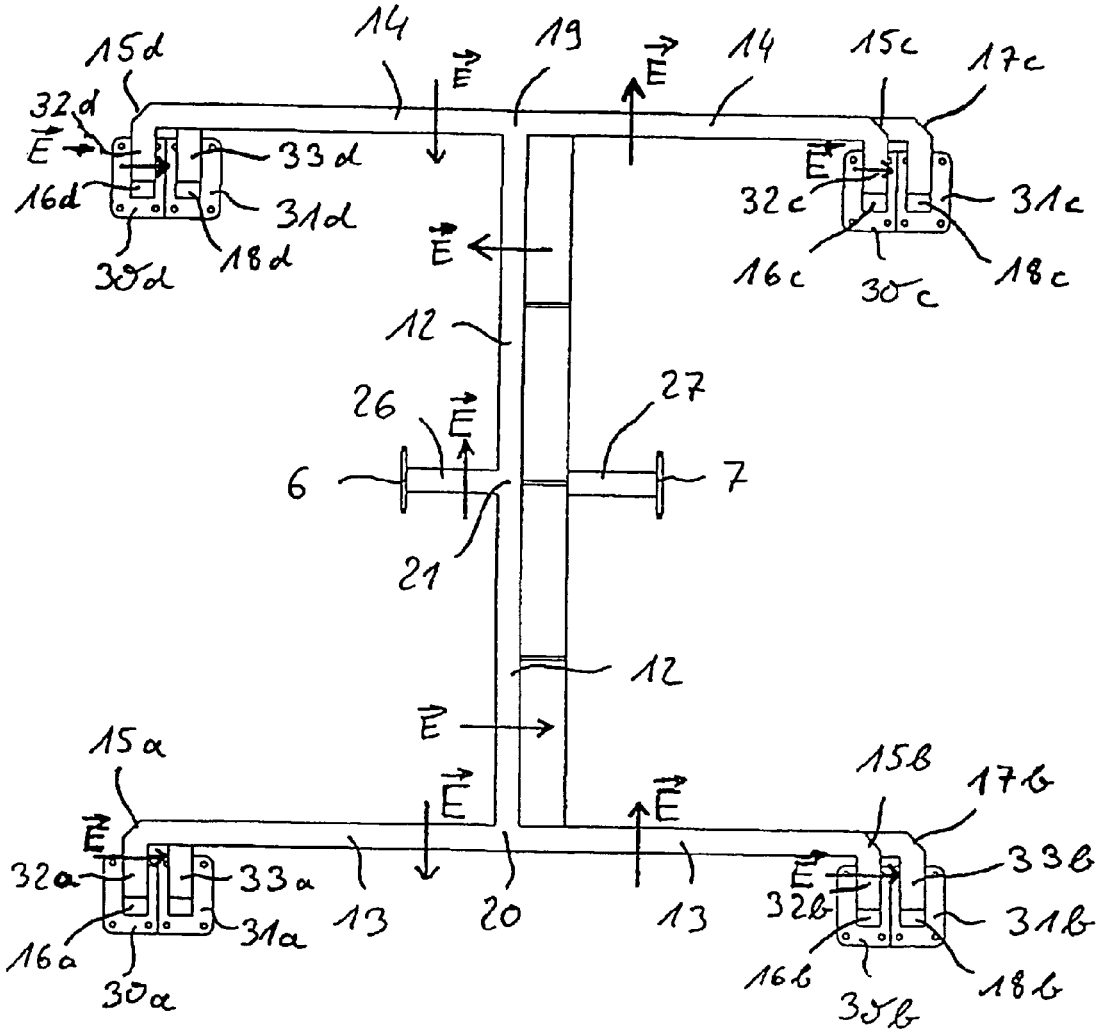
FIG. 5 is a top view of the waveguide configuration according to FIGS. 1 to 4.
Figure 8:
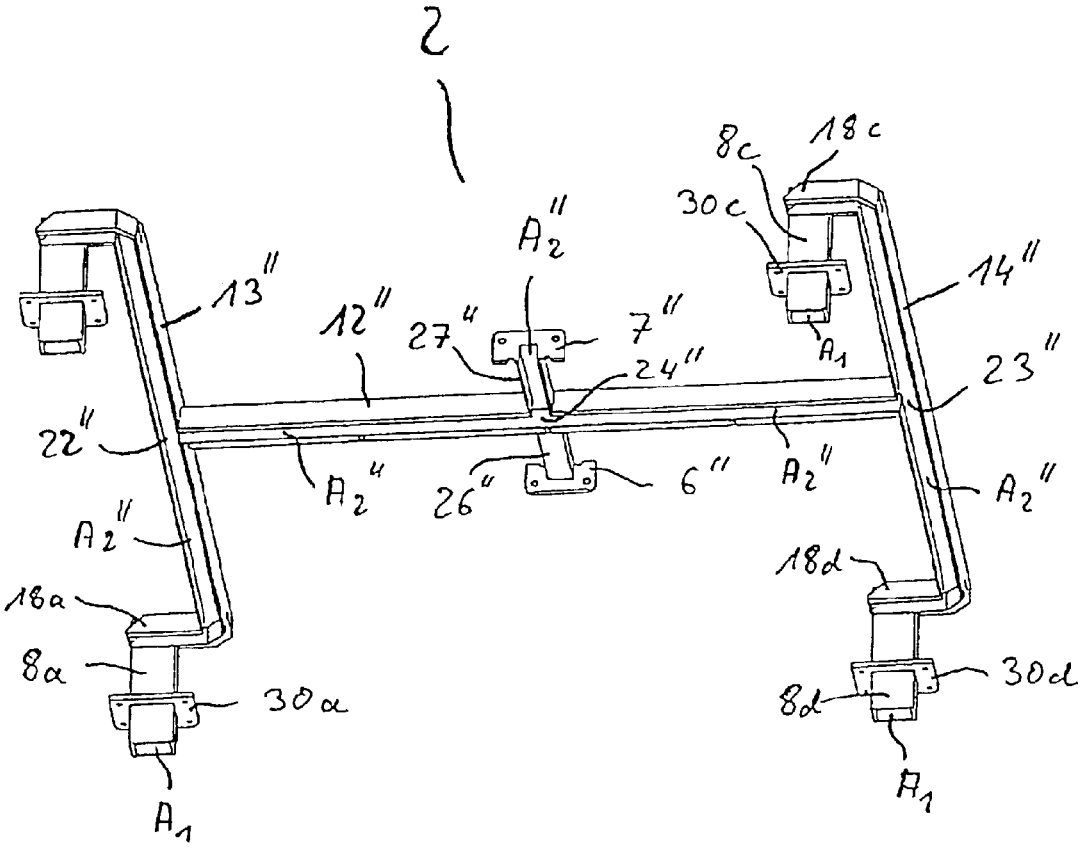
FIGS. 8,9 are perspective views of the centre part of the waveguide configuration.
Figure 9:
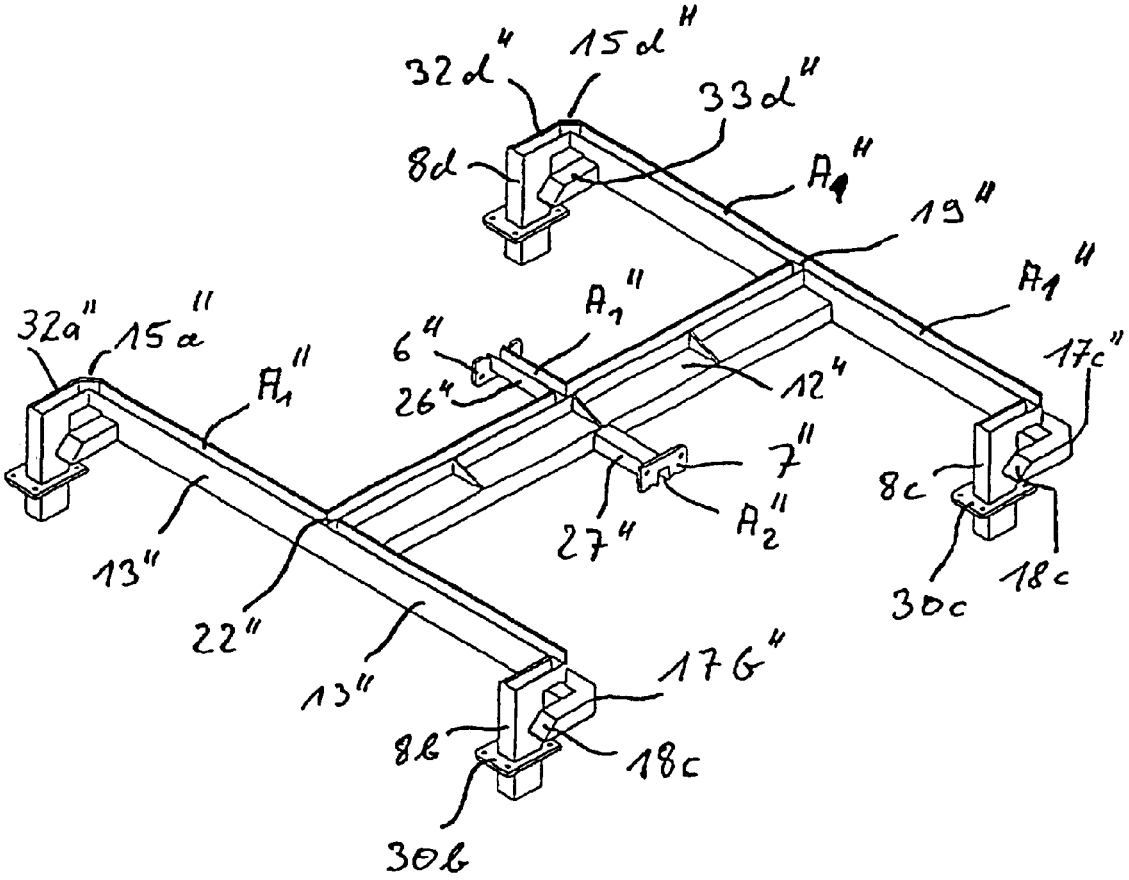
Figure 10:
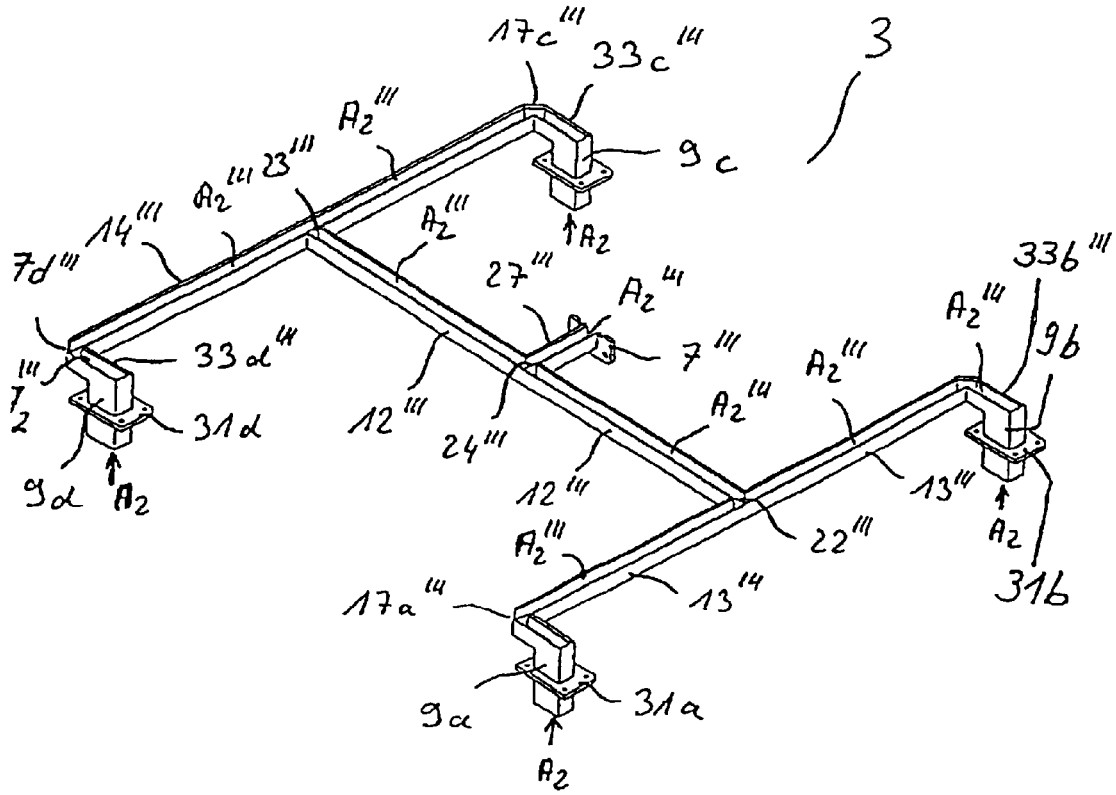
FIG. 10 is a perspective view of the lower cover part of the waveguide configuration adjacent to the planar antenna.

FIG. 2 shows an exploded representation of the waveguide configuration according to FIG. 1. The recesses used to form the waveguides $A_1$ and $A_2$ in parts 2 and 3 can be clearly seen. A precise explanation of the operation of the waveguides $A_1$ and $A_2$ emerges from FIG. 5, which shows a top view of the waveguide configuration. To clarify the operation, the E-field components for the waveguide configuration $A_1$ are represented by vector arrows marked 'E'. The $H_{10}$ mode is fed into the coupling point 6 of the waveguide $A_1$, the E-field vector pointing upwards. At point 21 an E-T-junction is effected, the electromagnetic wave being propagated in the upper and lower waveguide part 12 with a phase difference of 180 degrees (arrows point in opposite directions). At points 19 and 20 further E-T-junctions are used, the electromagnetic wave being again divided in the waveguides 13 and 14 in an antiphase manner and progressing to the angle pieces 15*a* to 15*d*, where it is turned in each case through 90 degrees by the angle pieces. The angle pieces 15*a* to 15*d* cause a rotation of the electromagnetic wave so that the waves are again equiphase at the antenna coupling points. As a result, the same antenna layouts can advantageously be used for the quadrant planar antennae (not illustrated). The bending by the angle pieces 16*a* to 16*d* does not cause rotation of the E-field vector; its purpose is only to guide the electromagnetic wave to the relevant feed point of the coupling networks which are implemented in planar technology. The electromagnetic wave for the waveguide $A_2$ is fed and rotated in an analogous way as for the waveguide $A_1$. The dimensions of the recesses and of the angle pieces depend, of course, on the selected frequency of the electromagnetic waves to be guided.

Figure 3:
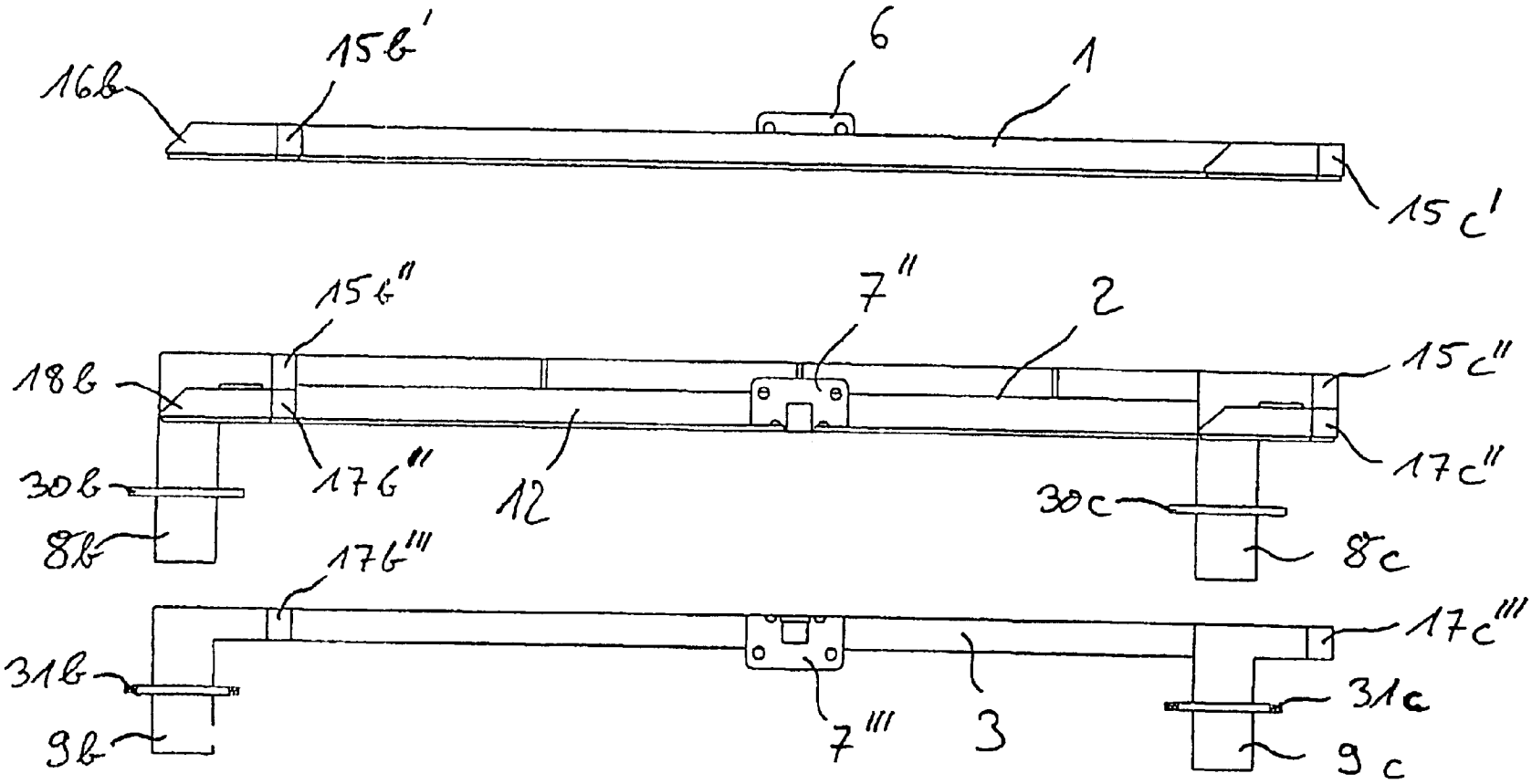
FIG. 3 is a side view of the exploded drawing of the waveguide configuration according to FIGS. 1 and 2.
Figure 4:
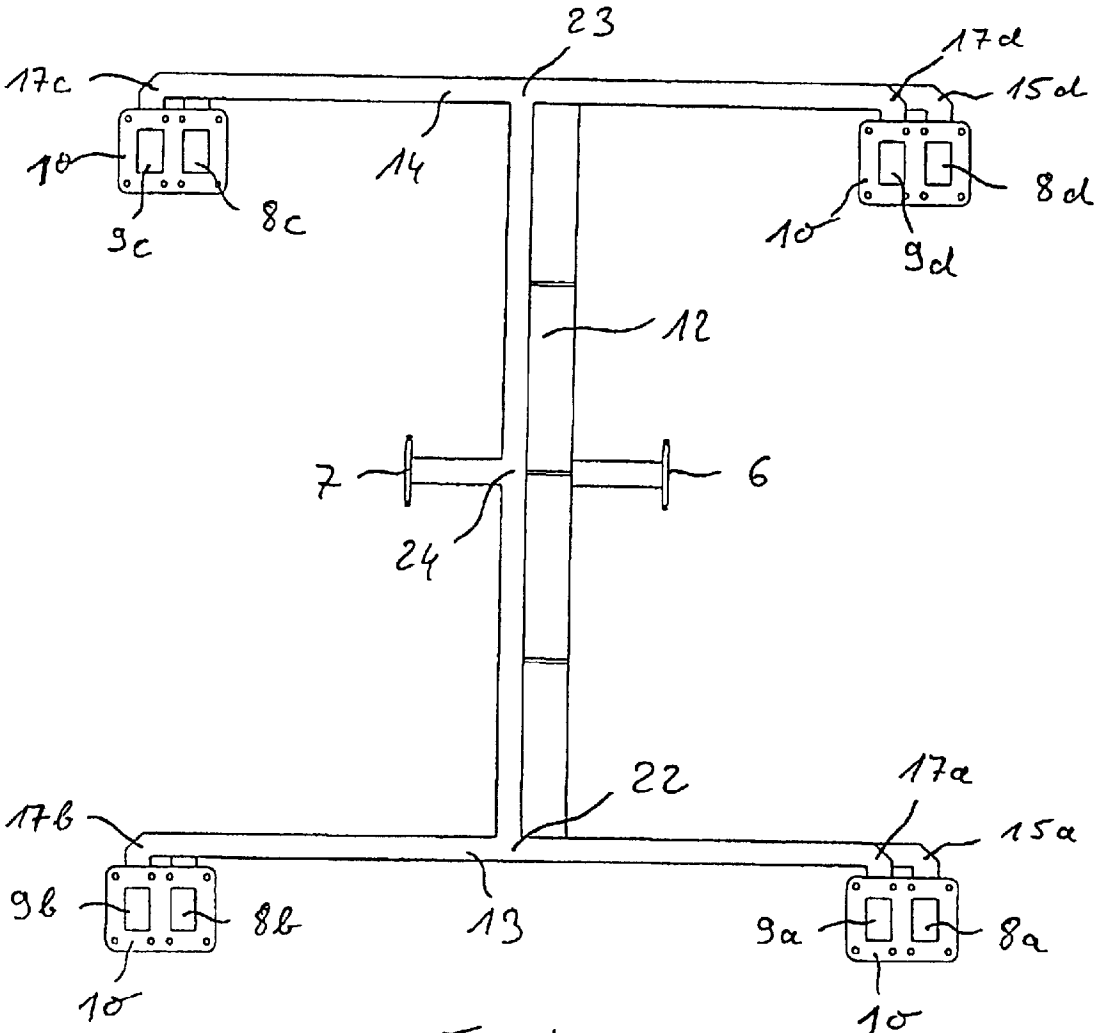
FIG. 4 is a view from below of the waveguide configuration according to FIGS. 1 to 3.

FIG. 3 shows a side view of parts 1, 2 and 3 in the unassembled state. The depth of the recesses for the waveguides $A_1$ and $A_2$ in parts 1 and 2, and 2 and 3 respectively, is the same in each case, so that only longitudinal currents flow along the dividing lines 4 and 5 in the assembled state. The free ends of the waveguide sections 8*a* to 8*d* and 9*a* to 9*d* pass through the planar waveguide configuration in the area of the coupling points, a transition between the waveguide and the planar waveguide structures being effected in each case.

The angle pieces 15 to 18 conduct the $H_{10}$ wave through 90 degrees in each case, so that the 180-degree phase angle rotations caused by the E-T-junctions 19 to 24 are compensated.

FIGS. 6 to 10 show perspective views of the two cover parts 1 and 3, and of the centre part 2. Where a reference character x' (single apostrophe) is used, this means that a component of the upper cover part 1 is designated. Where a reference character x" (double apostrophe) is used, this means that a component of the centre part 2 is designated. Components formed by the lower cover part 3 are denoted analogously by x'''. The form of the cross-section of the waveguide depends, as already explained, on the frequency of the wave to be conducted.

Parts 1, 2 and 3 can be bonded or welded together, or otherwise permanently joined, for easy assembly. It is thereby ensured that the waveguide is not soiled or that moisture cannot penetrate the waveguide.

Self-evidently, planar antennae in which the objective is not to couple in the waves at the coupling points between waveguide configuration and planar antenna with equal amplitude and in an in-phase manner also fall within the protection of this patent. The form and sequence of the E-T-junctions and of the angle pieces is in principle freely selectable. If, however, the same layouts are to be used for the coupling networks of the individual sub-antennae it need only be ensured that the waveguide configuration feeds the waves into the coupling networks in an equiphase manner at the coupling points.

What is claimed is:

1. A planar antenna comprising at least two groups of radiating elements arranged in one plane, which are connected to one coupling point in each case by means of one transmission network in each case, one waveguide configuration connecting the coupling points to a common central coupling point, characterized in that two parts arranged one above the other form the waveguide configuration, the parts having recesses which together form the cavities of the waveguides, the depths of the recesses of the parts being equal, such that the contact edges of the recesses coincide with the centre line of the side, in particular the wide side, of the waveguide in which only longitudinal currents flow.

2. A planar antenna according to claim 1, characterised in that the E-field vectors of the electromagnetic waves conducted in the waveguide configuration are oriented parallel to the flat sides of the planar antennae.

3. A planar antenna according to claim 1, characterised in that at least the inner faces of the recesses are formed by an electrically conductive material.

4. A planar waveguide according to claim 1, characterized in that the transmission networks are implemented using planar technology, in particular stripline, coplanar, microstrip or slotline technology, and between the coupling points and the waveguide configuration a transition is effected in each case bet ween the waveguide and the planar waveguide structures.

5. A planar antenna according to claim 1, characterised in that one transition element in e each case is arranged between each coupling point and the waveguide configuration.

6. A planar antenna according to claim 1, characterised in that each group has the same number of radiating elements.

7. A planar antenna according to claim 1, characterised in that four groups of radiating elements are present in each plane of the planar antenna, each group forming a quadrant and two predominantly rectilinear connecting waveguides being arranged parallel to one another and in each case connecting coupling points of two adjacent quadrants, and in that the two connecting waveguides are connected by means of a further, in particular rectilinear, waveguide which adjoins the centres of the two waveguides, and in that the central common coupling point through which the electromagnetic waves are fed into or coupled out of the further waveguide is arranged at the centre of this waveguide.

8. A planar antenna according to claim 7, characterised in that a feed waveguide is connected at the centre of the further waveguide for feeding in or coupling out or for forming the central common coupling point, the wave arriving from the feed waveguide being divided in an antiphase manner between the two arms of the fur the r waveguide (series or E-junction).

9. A planar antenna according to claim 7, characterised in that the wave arriving from one arm of the further waveguide is divided in an antiphase manner between the two arms of the connecting waveguide concerned (series or E-junction).

10. A planar antenna according to claim 7, characterised in that the waveguides are arranged at least zonally, i.e. in particular up to the transitions between the waveguide and the planar waveguide structures, parallel to the groups of radiating elements.

11. A planar antenna according to claim 1, characterised in that the layouts of the transmission networks for the groups of radiating elements are the same.

12. A planar antenna according to claim 1, characterised in that for in-phase feeding in the stripline waveguide transitions between the rectilinear arms of the connecting waveguides and the transitions between the waveguides and the planar waveguide structures at least one angle piece or bend is present in each case.

13. A planar antenna according to claim 12, characterised in that an angle piece or bend is connected to each end of the rectilinear arm, by means of which bend the direction of the energy flow in the E-plane is changed, and in that connected thereto in each case is an angle piece or bend by means of which the direction of the energy flow in the H-plane is changed, and connected thereto in each case is a waveguide which, together with the transmission network, forms a transition between the waveguide and the planar waveguide structures.

14. A planar antenna according to claim 1, characterised in that the groups of radiating elements of one plane are formed by two conductive layers arranged in a surface-parallel manner and spaced apart, and by the transmission networks, the conductive layers being formed in particular of foils of conductive material having non-conductive window-like spaces formed e.g. by punching, cutting or etching, and in that the transmission networks are arranged between the conductive layers at a distance therefrom, the ends of the transmission lines, which are implemented by means of planar technology, in particular stripline, coplanar, microstrip or slotline technology, form resonator elements which extend into the area of the window-like spaces.

15. A planar antenna according to claim 1, characterised in that the parts of the waveguide configuration are injection-moulded parts, in particular of plastics material, and at least the inner walls of the recesses are metallised or covered with a conductive layer.

16. A planar antenna according to claim 15, characterised in that the parts are connectable by means of snap connections or are bonded using an, in particular conductive, bonding agent.

17. A planar antenna comprising groups of radiating elements arranged in two planes, at least two groups being arranged in one plane and each group of radiating elements being connected to a coupling point belonging to the group by means of one transmission network in each case, one waveguide configuration connecting the coupling points of each plane to a common central coupling point in each case, characterised in that three parts stacked in sandwich formation form the waveguide configuration, said parts having recesses which together form the cavities of the waveguides, the centre part having recesses in the faces adjacent to the two other parts to form waveguides, the depths of the recesses of the parts being equal, such that the contact edges of the recesses coincide with the centre-line of the side, in particular the wide side, of the waveguide in which only longitudinal currents flow.

18. A planar antenna according to claim 17, characterised in that the E-field vectors of the electromagnetic waves conducted in the waveguide configuration are oriented parallel to the flat sides of the planar antennae.

19. A planar antenna according to claim 17, characterised in that at least the inner faces of the recesses are formed by an electrically conductive material.

20. A planar waveguide according to claim 17, characterised in that the transmission networks are implemented using planar technology, in particular stripline, coplanar, microstrip or slotline technology, and between the coupling points and the waveguide configuration a transition is effected in each case between the waveguide and the planar waveguide structures.

21. A planar antenna according to claim 17, characterised in that one transition element in each case is arranged between each coupling point and the waveguide configuration.

22. A planar antenna according to claim 17, characterised in that each group has the same number of radiating elements.

23. A planar antenna according to claim 17, characterised in that four groups of radiating elements are present in each plane of the planar antenna, each group forming a quadrant and two predominantly rectilinear connecting waveguides being arranged parallel to one another and in each case connecting coupling points of two adjacent quadrants, and in that the two connecting waveguides are connected by means of a further, in particular rectilinear, waveguide which adjoins the centres of the two waveguides, and in that the central common coupling point through which the electromagnetic waves are fed into or coupled out of the further waveguide is arranged at the centre of this waveguide.

24. A planar antenna according to claim 23, characterised in that a feed waveguide is connected at the centre of the further waveguide for feeding in or coupling out or for forming the central common coupling point, the wave arriving from the feed waveguide being divided in an antiphase manner between the two arms of the further waveguide (series or E-junction).

25. A planar antenna according to claim 23, characterised in that the wave arriving from one arm of the further waveguide is divided in an antiphase manner between the two arms of the connecting waveguide concerned (series or E-junction).

26. A planar antenna according to claim 23, characterised in that the waveguides are arranged at least zonally, i.e. in particular up to the transitions between the waveguide and the planar waveguide structures, parallel to the groups of radiating elements.

27. A planar antenna according to claim 17, characterised in that the layouts of the transmission networks for the groups of radiating elements are the same.

28. A planar antenna according to claim 17, characterised in that for in-phase feeding in the stripline waveguide transitions between the rectilinear arms of the connecting waveguides and the transitions between the waveguides and the planar waveguide structures at least one angle piece or bend is present in each case.

29. A planar antenna according to claim 28, characterised in that an angle piece or bend is connected to each end of the rectilinear arm, by means of which bend the direction of the energy flow in the E-plane is changed, and in that connected thereto in each case is an angle piece or bend by means of which the direction of the energy flow in the H-plane is changed, and connected thereto in each case is a waveguide which, together with the transmission network, forms a transition between the waveguide and the planar waveguide structures.

30. A planar antenna according to claim 17, characterised in that the groups of radiating elements of one plane are formed by two conductive layers arranged in a surface-parallel manner and spaced apart, and by the transmission networks, the conductive layers being formed in particular of foils of conductive material having non-conductive window-like spaces formed e.g. by punching, cutting or etching, and in that the transmission networks are arranged between the conductive layers at a distance therefrom, the ends of the transmission lines, which are implemented by means of planar technology, in particular stripline, coplanar, microstrip or slotline technology, form resonator elements which extend into the area of the window-like spaces.

31. A planar antenna according to claim 17, characterised in that the parts of the waveguide configuration are injection-moulded parts, in particular of plastics material, and at least the inner walls of the recesses are metallised or covered with a conductive layer.

32. A planar antenna according to claim 31, characterised in that the parts are connectable by means of snap connections or are bonded using an, in particular conductive, bonding agent.

* * * * *